US009356388B2

(12) United States Patent
Aizawa et al.

(10) Patent No.: US 9,356,388 B2
(45) Date of Patent: May 31, 2016

(54) TERMINAL-ATTACHED WIRE AND TERMINAL

(71) Applicants: AUTONETWORKS TECHNOLOGIES, LTD, Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Takeshi Aizawa, Yokkaichi (JP); Satoshi Morikawa, Yokkaichi (JP); Yoshihiro Uchiyama, Yokkaichi (JP); Kazuaki Takeda, Yokkaichi (JP); Takashi Tonosaki, Yokkaichi (JP)

(73) Assignee: AUTONETWORKS TECHNOLOGIES, LTD, Yokkaichi-shi, Mie (JP)

( * ) Notice: Subject to any disclaimer, the term of this patent is extended or adjusted under 35 U.S.C. 154(b) by 0 days.

(21) Appl. No.: 14/364,246

(22) PCT Filed: Nov. 28, 2012

(86) PCT No.: PCT/JP2012/080705

§ 371 (c)(1),
(2) Date: Jun. 10, 2014

(87) PCT Pub. No.: WO2013/088953

PCT Pub. Date: Jun. 20, 2013

(65) Prior Publication Data

US 2014/0349501 A1 Nov. 27, 2014

(30) Foreign Application Priority Data

Dec. 12, 2011 (JP) ..... 2011-271028
Jan. 25, 2012 (JP) ..... 2012-013101

(51) Int. Cl.

| | |
|---|---|
| ***H01R 13/52*** | (2006.01) |
| ***H01R 4/72*** | (2006.01) |
| ***H01R 4/62*** | (2006.01) |
| *H01R 4/18* | (2006.01) |

(52) U.S. Cl.
CPC ..... *H01R 13/5227* (2013.01); *H01R 4/62* (2013.01); *H01R 4/72* (2013.01); *H01R 13/5221* (2013.01); *H01R 4/185* (2013.01)

(58) Field of Classification Search
CPC . H01R 13/52; H01R 13/5227; H01R 13/5221
See application file for complete search history.

(56) References Cited

U.S. PATENT DOCUMENTS 8,309,847 B2 * 11/2012 Aburaya et al. ..... 174/50

FOREIGN PATENT DOCUMENTS

JP 10-289745 * 10/1998 ..... H01R 11/12
JP 2000-285983 10/2000

(Continued)

OTHER PUBLICATIONS

English Translation of JP 10-289745, published Oct. 27, 1998, translation made Jun. 1, 2015.*

(Continued)

*Primary Examiner* — Amy Cohen Johnson
*Assistant Examiner* — Matthew T Dzierzynski
(74) *Attorney, Agent, or Firm* — Gerald Hespos; Michael Porco; Matthew Hespos

(57) ABSTRACT

A terminal (15) of a terminal-attached wire (10), in which the terminal (15) is connected to an end portion of a wire (11) and the end portion is sealed by a heat shrinkable tube (33), includes a terminal connecting portion (16) to be connected to a mating terminal, a wire connecting portion (18) to be connected to the end portion of the wire (11) and a coupling portion (22) coupling the terminal connecting portion (16) and the wire connecting portion (18) An opening end (33A) of the heat shrinkable tube (33) is mounted on the coupling portion (22), and a draining portion (32) for preventing adhering water from running down to the opening end (33A) is provided on a side closer to the terminal connecting portion (16) than the opening end (33A).

16 Claims, 4 Drawing Sheets

(56) References Cited

FOREIGN PATENT DOCUMENTS

| | | |
|---|---|---|
| JP | 2008-135278 | 6/2008 |
| JP | 2008176970 | 7/2008 |
| JP | 2010049941 | 3/2010 |

OTHER PUBLICATIONS

English Translation of JP 2008-176970, published Jul. 31, 2008, translation made Jun. 1, 2015.*

International Search Report of Jan. 22, 2013.

Written Opinion of Jan. 22, 2013.

Japanese Patent Appl. No. 2012-01310—Office Action issued Feb. 3, 2015.

Korean Office Action issued on Aug. 19, 2015.

Chinese Patent Appl. No. 2012-80057509.9—Office Action issued Aug. 17, 2015.

* cited by examiner

TERMINAL-ATTACHED WIRE AND TERMINAL

TECHNICAL FIELD

The present invention relates to a terminal-attached wire and a terminal.

BACKGROUND ART

Conventionally, a terminal-attached wire provided with a wire and a terminal crimped to a wire end is known from Japanese Unexamined Patent Publication No. 2000-285983. The terminal-attached wire of Japanese Unexamined Patent Publication No. 2000-285983 is used, for example, in an engine compartment of an automotive vehicle. Since water can normally intrude into the engine compartment, there is a possibility that water adheres to a connecting part of the terminal and the wire. If water adheres to this connecting part, the terminal and a core made of a metal material is corroded. Particularly, when mutually different metal members are connected such as when the terminal is made of copper and the core is made of aluminum, corrosion is likely to occur. Thus, a heat shrinkable tube is fitted around the connecting part in the terminal-attached wire disclosed in Japanese Unexamined Patent Publication No. 2000-285983. By fitting the heat shrinkable tube in this way, water does not come into contact with the connecting part of the terminal-attached wire from the surrounding.

Water that can intrude into the connecting part of the terminal and the wire flows not only in a circumferential direction of the heat shrinkable tube, but may also flow from a tip side of the terminal. In Japanese Unexamined Patent Publication No. 2000-285983, water may intrude from a boundary part between the tip side of the heat shrinkable tube and the terminal.

The present invention was completed based on the above situation and aims to provide a terminal-attached wire and a terminal having improved waterproofness.

SUMMARY OF THE INVENTION

The present invention is directed to a terminal-attached wire in which a terminal is connected to an end portion of a wire and the end portion is sealed by a sealing portion, wherein the terminal includes a terminal connecting portion to be connected to a mating terminal, a wire connecting portion to be connected to the end portion of the wire, and a coupling portion coupling the terminal connecting portion and the wire connecting portion, an end part of the sealing portion is mounted on the coupling portion and a draining portion for preventing adhering water from running down to the end part of the sealing portion is provided on a side closer to the terminal connecting portion than the end part of the sealing portion.

The present invention is also directed to a terminal to be connected to an end portion of a wire to be sealed by a sealing portion, including a terminal connecting portion to be connected to a mating terminal; a wire connecting portion to be connected to the end portion of the wire; and a coupling portion coupling the terminal connecting portion and the wire connecting portion; wherein an end part of the sealing portion is mounted on the coupling portion and a draining portion for preventing adhering water from running down to the end part of the sealing portion is provided on a side closer to the terminal connecting portion than the end part of the sealing portion.

According to the above configurations, since water running down from the side of the terminal connecting portion can be drained by the draining portion, it is possible to prevent water from running down to the end part of the sealing portion. Thus, it is possible to prevent the intrusion of water into the end portion of the wire from a boundary part between the coupling portion and the end part of the sealing portion, wherefore the waterproofness of the terminal-attached wire and the terminal can be improved.

The following configurations are preferable as embodiments of the invention.

The draining portion is a step portion rising in a step-like manner.

This can prevent the intrusion of water into the end portion of the wire by a simple configuration.

The draining portion is a cut surface formed by cutting a metal plate material and provided on a side edge part of the coupling portion. This facilitates the drainage of adhering water due to a rough uneven shape of the cut surface.

The coupling portion is formed of a bent metal plate material, and the draining portion is formed by a cut portion provided on a side edge part of the coupling portion.

This enables the formation of the draining portion by a simple configuration.

A water-stop wall is formed by bending a water-stop piece rising from the coupling portion, and the draining portion is formed by the water-stop piece. This enables the formation of the draining portion utilizing a configuration for forming the water-stop wall.

The coupling portion includes an end mounting portion on which the end part of the sealing portion is to be mounted, and the end mounting portion is configured to include the outer periphery of the water-stop piece. This enables the formation of the end mounting portion to be sealed by the end part of the sealing portion, utilizing the water-stop piece for forming the water-stop wall.

The coupling portion is formed of a bent metal plate material, and the draining portion is a projecting piece formed by extending a side edge part of the coupling portion. This enables the formation of the draining portion by a simple configuration.

The coupling portion includes an inclined portion inclined to guide adhering water toward the draining portion. This enables water to be guided to the draining portion along the inclined portion.

The sealing portion is a waterproof tube.

This enables the intrusion of water in a circumferential direction of the sealing portion to be reliably prevented.

The waterproof tube is a heat shrinkable tube. This can simplify an operation of mounting the waterproof tube.

According to the present invention, it is possible to improve waterproofness.

DETAILED DESCRIPTION OF THE PREFERRED EMBODIMENTS

A terminal-attached wire 10 according to an embodiment of the present invention is described with reference to FIGS. 1 to 3.

Figure 1:
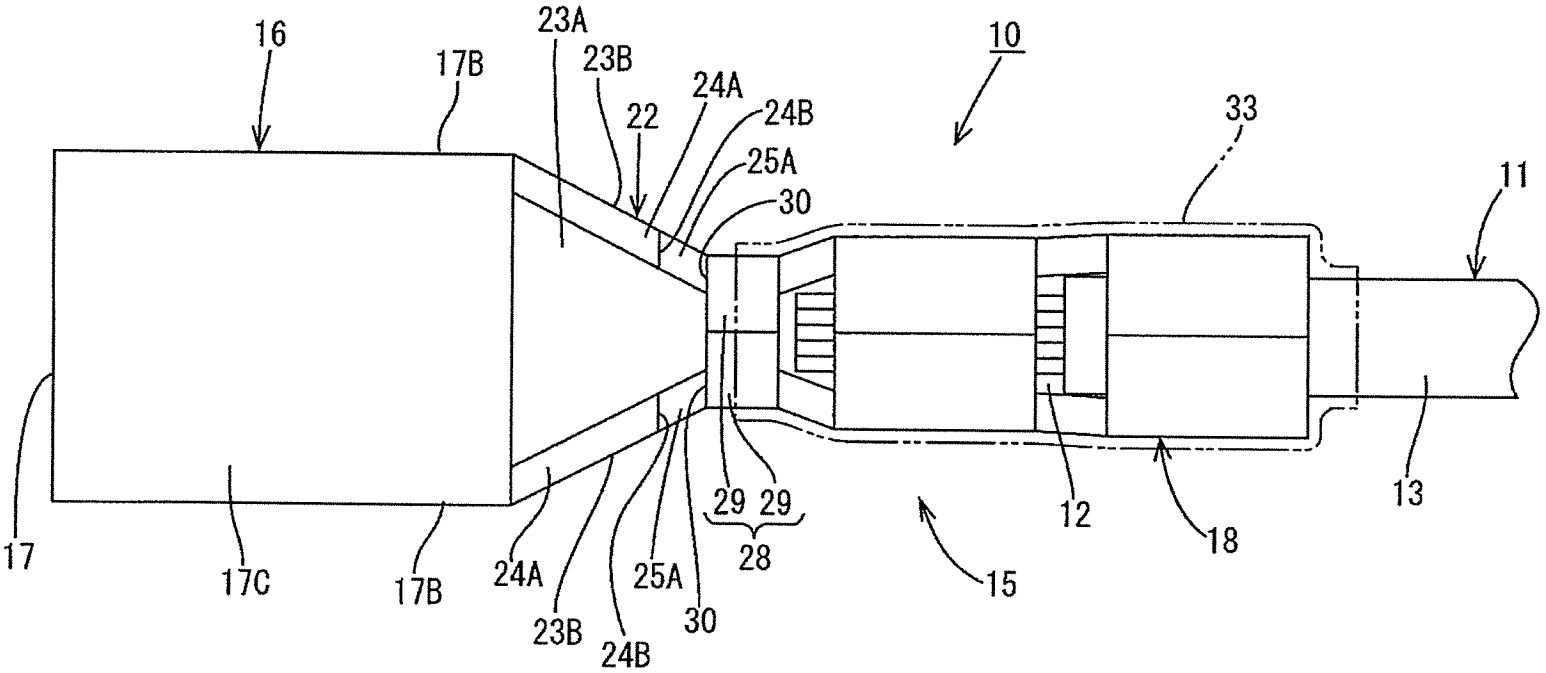
FIG. 1 is a plan view showing a terminal-attached wire of a first embodiment.
Figure 2:
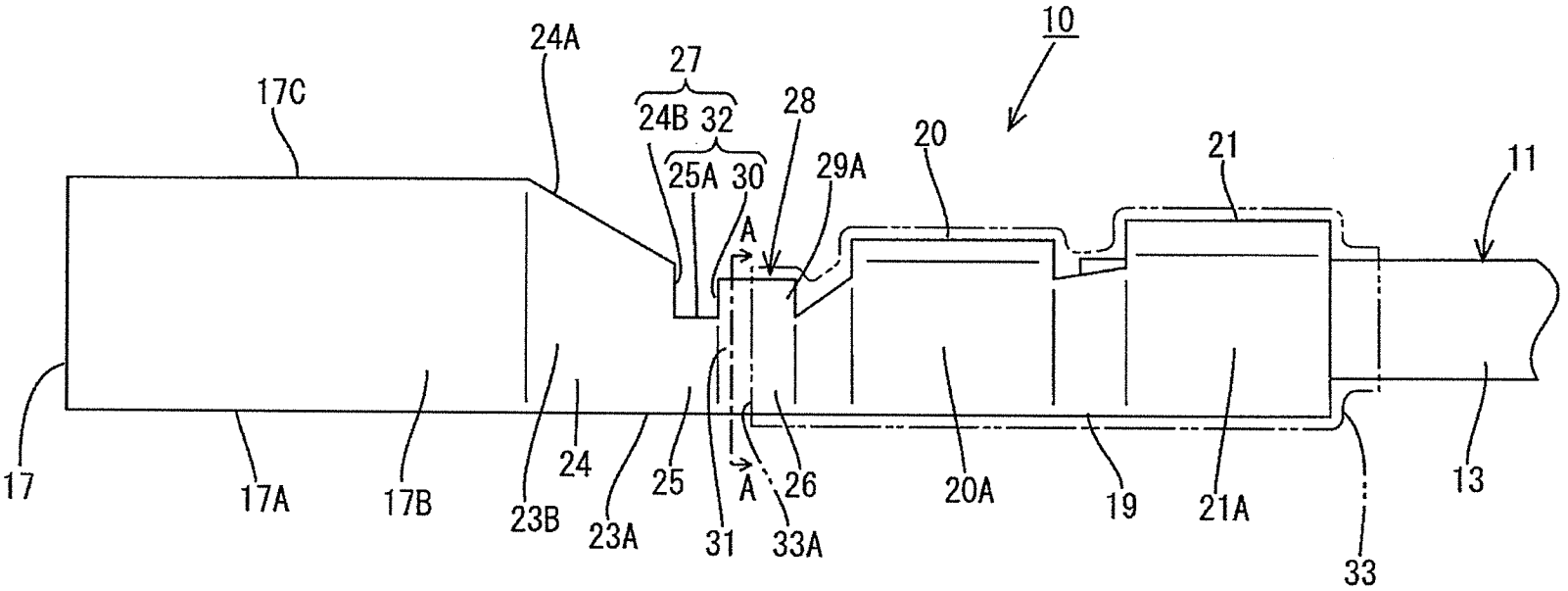
FIG. 2 is a side view showing the terminal-attached wire.

As shown in FIG. 1, the terminal-attached wire 10 includes a wire 11, a terminal 15 to be mounted on an end of this wire 11 and a heat shrinkable tube 33 (an example of a "sealing portion" and "a waterproof tube" as an element of the present invention) to be fitted to surround an end portion of the wire 11. This terminal-attached wire 10 is accommodated in a posture (vertical orientation) of FIG. 2 in a cavity of an unillustrated connector housing. A vertical direction is based on FIG. 2 and left and right sides of FIG. 2 are respectively referred to as front and rear sides below.

As shown in FIG. 1, the wire 11 includes a conductor 12 formed by twisting a plurality of metal strands and an insulation coating 13 (insulation layer) made of synthetic resin for covering the outer periphery of the conductor 12. Examples of a material constituting the conductor 12 include copper, copper alloy, aluminum and aluminum alloy, and an arbitrary metal material is appropriately selected according to need. The insulation coating 13 is removed at the end portion of the wire 11 to expose the conductor 12. Note that a single-core wire composed of one conductor may be used for the conductor 12.

The terminal 15 is a female terminal to be connected to an unillustrated mating male terminal and includes a terminal connecting portion 16 to be connected to the mating terminal, a wire connecting portion 18 to be connected to the end portion of the wire 11 and a coupling portion 22 integrally coupling the terminal connecting portion 16 and the wire connecting portion 18.

The terminal connecting portion 16 is provided on a tip side of the terminal 15 and includes a rectangular tube portion 17 having a rectangular cross-section. The rectangular tube portion 17 is formed by annularly connecting a bottom plate portion 17A, a pair of side wall portions 17B, 17B and a ceiling plate portion 17C. In this rectangular tube portion 17, a resilient contact piece (not shown) to be resiliently brought into contact with the mating terminal is provided resiliently deformably with a tip side of the bottom plate portion 17A as a base end.

The wire connecting portion 18 is composed of a U-shaped placing portion 19 in which the wire 11 is to be placed, a wire barrel portion 20 to be caulked and crimped to the conductor 12 and an insulation barrel portion 21 to be caulked on the insulation coating 13 to hold the wire 11.

The wire barrel portion 20 is composed of a pair of caulking pieces 20A, 20A, which rise from the upper edges of the placing portion 19 before the terminal 15 is mounted on the wire 11. This wire barrel portion 20 is so crimped to the conductor 12 on the bottom plate portion 17A as to embrace the conductor 12 when the terminal 15 is mounted on the wire 11. Serration (not shown) for removing an oxide film by being abraded against the conductor 12 at the time of crimping is formed by providing recesses on the inner surface of the wire barrel portion 20 and the inner surface of the placing portion 19 in this part.

The insulation barrel portion 21 is composed of a pair of caulking pieces 21A, 21A, which rise from the upper edges of the placing portion 19 and extend upward from the upper edges of the placing portion 19 before the terminal 15 is mounted on the wire 11. This insulation barrel portion 21 is so crimped to the insulation coating 13 on the end portion of the wire 11 as to embrace the insulation coating 13.

The coupling portion 22 includes an extending portion 23 extending backward from the terminal connecting portion 16 while gradually reducing a width and a water-stop wall 28 provided on a rear end part of the extending portion 23 to prevent the intrusion of water toward the end of the wire 11. The extending portion 23 includes a bottom plate portion 23A in the form of a flat plate and side wall portions 23B, 23B rising at a right angle from left and right edges of the bottom plate portion 23A.

The bottom plate portion 23A is shaped to gradually reduce a width toward a rear side. As shown in FIG. 2, the side wall portion 23B includes a first wall portion 24 whose height is gradually reduced from the rear end of the terminal connecting portion 16 toward a rear side, a second wall portion 25 formed to have a lower height than the first wall portion 24 and fall in a step-like manner from the rear end of the first wall portion, and a third wall portion 26 connected to and behind the second wall portion 25 and including a water-stop piece 29 from the upper end.

The upper end of the first wall portion 24 serves as an inclined portion 24A inclined downward toward a rear side. Water adhering to this inclined portion 24A moves backward along this inclined portion 24A. Base end portions 29A, 29A of the water-stop pieces 29, 29 forming the water-stop wall 28 are connected to and above the upper ends of the third wall portions 26, and the front edges of the base end parts 29A of the water-stop pieces 29 serve as step portions 30 rising in the vertical direction in a step-like manner from upper ends 25A of the second wall portions 25. A rectangular cut portion 27 formed in an upper end part of the side wall portion 23B is defined by a side edge 24B of the first wall portion 24, the upper end 25A of the second wall portion 25 and the step portion 30.

In this way, water drops running down along the inclined portions 24A collide with the upper ends 25A of the second wall portions 25 and the step portions 30, and drained inwardly or outwardly here. Thus, the upper ends 25A of the second wall portions 25 and the step portions 30 serve as a draining portion 32 for draining water running down along the inclined portion 24A.

Figure 3:
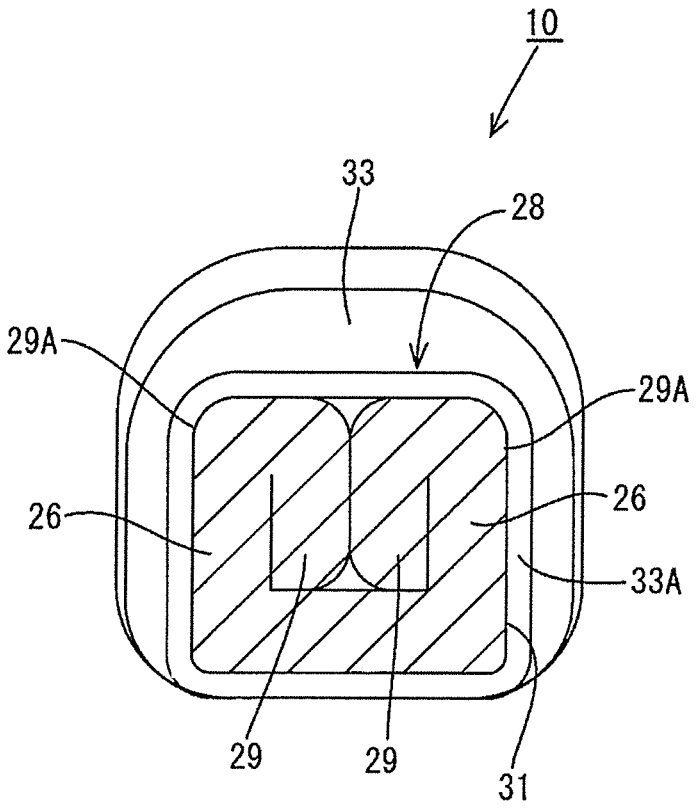
FIG. 3 is a section along A-A of FIG. 2.

As shown in FIG. 3, the water-stop wall 28 is composed of the pair of water-stop pieces 29, 29 connected on the respective upper ends of a pair of left and right third wall portions 26. The pair of water-stop pieces 29, 29 are folded inwardly and squeezed between the pair of left and right third wall portions 26, 26.

The pair of water-stop pieces 29, 29 are in the form of strips connected to and above the third wall portions 26 before the water-stop wall 28 is formed. The water-stop pieces 29, 29 (area of the water-stop pieces 29, 29 in a front-back direction) are sandwiched from upper and lower sides by a pair of upper and lower dies, and deformed and folded. The area of the water-stop pieces 29, 29 is pressed in a circumferential direction and squeezed such that the outer periphery has a rectangular shape, whereby the water-stop wall 28 is formed between the left and right third wall portions 26.

A rectangular outer surface formed by the bottom plate portion 23A, the side wall portions 23B, 23B and the water-stop pieces 29 serves as an end mounting portion 31 on which a front opening end 33A of the heat shrinkable tube 33 (an example of an "end part of the sealing portion" as an element of the present invention) is mounted, and the tubular opening end 33A is held in close contact with the end mounting portion 31 by thermal shrinkage of the heat shrinkable tube 33.

Examples of a metal material constituting the terminal 15 include copper and copper alloy, and an arbitrary metal material is appropriately selected according to need. Note that a plating layer (not shown) is formed on a surface of the metal material of the terminal 15 of this embodiment. Examples of a metal constituting the plating layer include tin and nickel and an arbitrary metal material is appropriately selected according to need. In this embodiment, a tin plating layer is formed on the surface of the metal material (copper or copper alloy) constituting the terminal 15. This terminal 15 is formed by punching out a metal plate material into a development shape of the terminal 15 and applying bending.

The heat shrinkable tube 33 is a tubular member made of a synthetic resin material which shrinks upon being heated. The front opening end 33A of the heat shrinkable tube 33 is held in close contact with the end mounting portion 31 while surrounding the end mounting portion 31, and a rear opening end is held in close contact with the insulation coating 13 on the end portion of the wire 11 while surrounding the insulation coating 13.

An adhesive layer (not shown) which is softened or melted by being heated to exhibit an adhesive property is formed on the inner peripheral surface of the heat shrinkable tube 33. A known adhesive used in the wire 11 of this type can be applied as an adhesive used in the adhesive layer. Note that it is also possible not to provide the adhesive layer on the inner peripheral surface of the heat shrinkable tube 33.

Next, a manufacturing process of the terminal-attached wire 10 according to this embodiment is described. The terminal 15 in which the water-stop pieces 29 and the caulking pieces 20A, 21A extend upward (before the water-stop wall 28 is formed and the terminal 15 is mounted on the wire 11) is formed by applying a punching process of punching the flat metal plate material into a development shape by a press machine and a bending process.

Then, the pair of water-stop pieces 29, 29 are sandwiched between the upper and lower dies, bent and folded, and squeezed between the left and right side wall portions 23B, 23B. Further, the wire 11 in which the insulation coating 13 is removed at the end portion of the wire 11 to expose the conductor 12 is placed on the placing portion 19 of the wire connecting portion 18, sandwiched by a lower die (anvil) and an upper die (crimper) to caulk the caulking pieces 20A, 20A; 21A, 21A. In this way, the wire barrel portion 20 is crimped to the conductor 12, the insulation barrel portion 21 is held onto a part of the insulation coating 13, and the terminal 15 is mounted on the end portion of the wire 11.

Note that a step of forming the water-stop wall 28 and a step of caulking the wire connecting portion 18 may be simultaneously performed.

Subsequently, the tubular heat shrinkable tube 33 in an unheated state is fitted on the end portion of the wire 11 where the terminal 15 is mounted. The heat shrinkable tube 33 may be fitted from the side of the terminal 15 or from the side of the wire 11.

A heating process is applied to the terminal 15 on the end portion of the wire 11 fitted with the heat shrinkable tube 33 in an unillustrated heating apparatus. In this heating process, the heat shrinkable tube 33 thermally shrinks. At this time, the front (one) opening end 33A of the heat shrinkable tube 33 is held in close contact with the end mounting portion 31 of the terminal 15 substantially without any clearance and the rear (other) opening end is held in close contact with the insulation coating 13 of the wire 11 without any clearance.

In this way, the terminal-attached wire 10 is formed.

According to this embodiment, the following functions and effects are achieved.

(1) In the terminal-attached wire 10, the terminal 15 is connected to the end portion of the wire 11 and the end portion is sealed by the heat shrinkable tube 33 (sealing portion). The terminal 15 includes the terminal connecting portion 16 to be connected to the mating terminal, the wire connecting portion 18 to be connected to the end portion of the wire 11 and the coupling portion 22 coupling the terminal connecting portion 16 and the wire connecting portion 18. The opening end 33A of the heat shrinkable tube 33 (end part of the sealing portion) is mounted on the coupling portion 22, and the draining portion 32 for preventing the adhering water from running down to the opening end 33A of the heat shrinkable tube 33 is provided on a side closer to the terminal connecting portion 16 than the opening end 33A of the heat shrinkable tube 33. According to this embodiment, since water running down from the side of the terminal connecting portion 16 can be drained by the draining portion 32, it is possible to prevent water from running down to the opening end 33A (end part of the sealing portion) of the heat shrinkable tube 33 (waterproof tube). Thus, it is possible to prevent the intrusion of water into the end portion of the wire 11 from a boundary part between the coupling portion 22 and the opening end 33A of the heat shrinkable tube 33 (end part of the sealing portion), wherefore the waterproofness of the terminal-attached wire 10 can be improved.

(2) The draining portion 32 is the step portions 30 rising in a step-like manner. This can prevent the intrusion of water into the end portion of the wire 11 by a simple configuration.

(3) The draining portion 32 is cut surfaces formed by cutting the metal plate material and provided on side edge parts of the coupling portion 22. This facilitates the drainage of adhering water due to rough uneven shapes of the cut surfaces.

(4) The coupling portion 22 is formed of the bent metal plate material and the draining portion 32 is formed by the cut portions 27 provided on the side edge parts of the coupling portion 22. This enables the formation of the draining portion 32 by a simple configuration.

(5) The water-stop wall 28 is formed by bending the water-stop pieces 29, 29 rising from the coupling portion 22, and the draining portion 32 is formed by the water-stop pieces 29, 29. This enables the formation of the draining portion 32 utilizing a configuration for forming the water-stop wall 28.

(6) The coupling portion 22 includes the end mounting portion 31 on which the opening end 33A of the heat shrinkable tube 33 (waterproof tube) is to be mounted, and the end mounting portion 31 is configured to include the outer peripheries of the water-stop pieces 29. This enables the formation of the end mounting portion 31, on which the opening 33A of the heat shrinkable tube 33 (waterproof tube) is mounted, utilizing the water-stop pieces 29 for forming the water-stop wall 28.

(7) The coupling portion 22 is provided with the inclined portions 24A inclined to guide adhering water toward the draining portion 32. This enables water to be guided to the draining portion 32 along the inclined portions 24A.

(8) The sealing portion is a waterproof tube. This enables the intrusion of water in a circumferential direction of the sealing portion to be reliably prevented.

(9) The waterproof tube is the heat shrinkable tube 33. This can simplify an operation of mounting the waterproof tube.

Figure 4:
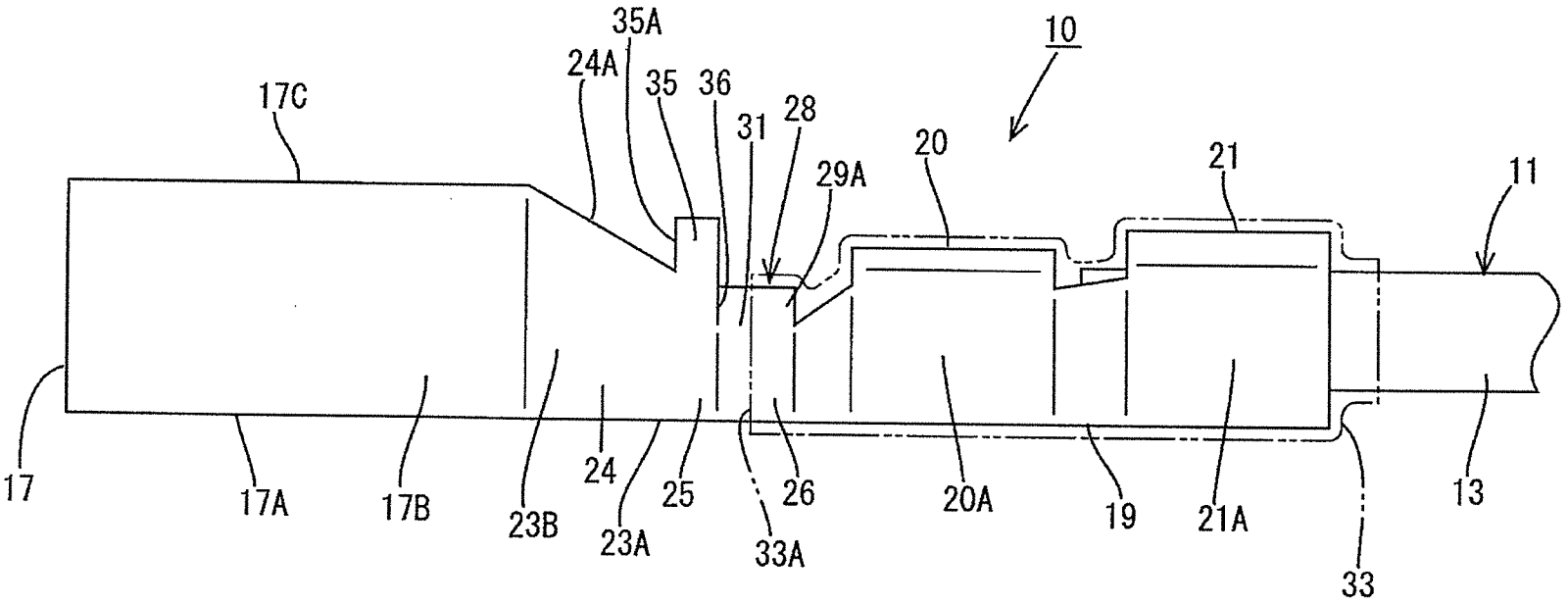
FIG. 4 is a plan view showing a terminal-attached wire of a second embodiment.

A second embodiment is described with reference to FIG. 4. The same components as in the first embodiment are denoted by the same reference signs and not described below.

In the second embodiment, the cut portions 27 of the first embodiment are not provided, and a pair of left and right projecting pieces 35, 35 projecting upward are provided on parts of second side walls 25 where the cut portions 27 are provided.

The projecting pieces 35 rise in a step-like manner from the rear ends (lower ends) of inclined portions 24A of first side walls, and the front edges of the projecting pieces 35 serve as step portions 35A (draining portion) for draining water adhering to the inclined portions 24A. Note that water-stop pieces 29 and the projecting pieces 35 are divided by slits 36 before a bending process, so that only the water-stop pieces 29 can be bent (without bending the projecting pieces 35).

According to the second embodiment, a coupling portion 22 is made of a bent metal plate material, and the step portions 35A (draining portion) are the projecting pieces 35 formed by extending side edge parts of the coupling portion 22. Thus, the step portions 35A can be formed by a simple configuration.

The present invention is not limited to the above described and illustrated embodiments. For example, the following embodiments are also included in the technical scope of the present invention.

Although the wire connecting portion 18 includes the insulation barrel portion 21 in the above embodiments, it may be composed only of the wire barrel portion without including the insulation barrel portion 21.

Although the terminal 15 is a female terminal in the above embodiments, there is no limitation to this. The terminal 15 may be a male terminal or a round terminal (so-called LA terminal). That is, the shape of the terminal 15 may be appropriately selected according to need.

Although the heat shrinkable tube 33 is used as the sealing portion for sealing the end portion of the wire in the above embodiments, there is no limitation to this. A waterproof tube other than the heat shrinkable tube may be used. Further, the sealing portion may be other than the tube. For example, the sealing portion may be formed by winding a tape around the end portion of the wire or molding the end portion of the wire with resin.

Although the draining portion is formed by the upper ends 25A of the second wall portions 25 and the step portions 30 in the above embodiment, there is no limitation to this. The draining portion may be formed by either the upper ends of the second wall portions or the step portions.

LIST OF REFERENCE SIGNS

10 . . . terminal-attached wire
11 . . . wire
12 . . . conductor
13 . . . insulation coating
15 . . . terminal
16 . . . terminal connecting portion
17 . . . rectangular tube portion
17A . . . bottom plate portion
18 . . . wire connecting portion
19 . . . placing portion
20 . . . wire barrel portion
21 . . . insulation barrel portion
22 . . . coupling portion
23 . . . extending portion
23B . . . side wall portion
24 . . . first wall portion
24A . . . inclined portion
24B . . . side edge of the first wall portion
25 . . . second wall portion
25A . . . upper end of the second wall portion
26 . . . third wall portion
27 . . . cut portion
28 . . . water-stop wall
29 . . . water-stop piece
29A . . . base end part of the water-stop piece
30, 35A . . . step portion
31 . . . end mounting portion
32 . . . draining portion
33 . . . heat shrinkable tube (sealing portion, waterproof tube)
33A . . . opening end (end part of the sealing portion)
35 . . . projecting piece

The invention claimed is:

1. A terminal-attached wire comprising:

a wire having an end portion;

a heat shrinkable tube that is a waterproof tube and that seals the end portion of the wire and has an opening edge and an inner peripheral surface adjacent the opening edge; and a terminal connected to the end portion of the wire, the terminal including:

a terminal connecting portion to be connected to a mating terminal, a wire connecting portion to be connected to the end portion of the wire, the terminal connecting portion and the wire connecting portion being spaced apart along a longitudinal direction, and a coupling portion coupling the terminal connecting portion and the wire connecting portion, the coupling portion including:

a bottom having opposite first and second sides, first and second side walls extending respectively from the opposite first and second sides of the bottom, first and second water-stop pieces extending respectively from ends of the first and second opposite side walls remote from the bottom and being bent inward from the opposite side walls along outer bend lines that extend substantially parallel to the longitudinal direction, each of the water-stop pieces further being bent at a location spaced from the respective side wall about an inner bend line that extends substantially parallel to the longitudinal direction so that a free end of the respective water-stop piece is opposed to and facing the bottom of the coupling portion, a mount portion being defined on an outer peripheral surface of each of the water stop pieces and the side walls, the mount portion extending from the bottom of the coupling portion to the inner bend lines, the opening edge of the heat shrinkable tube terminating on the mount portion and the inner peripheral surface of the heat shrinkable tube adjacent the opening edge of the heat shrinkable tube closely contacting the mount portion, and a draining portion provided on a side closer to the terminal connecting portion than the opening edge of the heat shrinkable tube for preventing water from running from a terminal connecting portion side to the opening edge of the heat shrinkable tube.

2. The terminal-attached wire of claim 1, wherein the draining portion is a step portion rising in a step-like manner.

3. The terminal-attached wire of claim 1, wherein the draining portion is a cut surface formed by cutting a metal plate material and provided on a side edge part of the coupling portion.

4. The terminal-attached wire of claim 1, wherein:

the coupling portion is formed of a bent metal plate material; and the draining portion is formed by a cut portion provided on a side edge part of the coupling portion.

5. The terminal-attached wire of claim 1, wherein the coupling portion is formed of a bent metal plate material; and the draining portion is a projecting piece formed by extending a side edge part of the coupling portion.

6. The terminal-attached wire of claim 1, wherein the coupling portion includes an inclined portion inclined to guide adhering water toward the draining portion.

7. A terminal to be connected to an end portion of a wire to be sealed by a heat shrinkable tube, an opening edge and an inner peripheral surface adjacent the opening edge, the terminal comprising:

a terminal connecting portion to be connected to a mating terminal;

a wire connecting portion to be connected to the end portion of the wire, the terminal connecting portion and the wire connecting portion being spaced apart along a longitudinal direction; and a coupling portion coupling the terminal connecting portion and the wire connecting portion, the coupling portion including:

a bottom having opposite first and second sides, first and second side walls extending respectively from the opposite first and second sides of the bottom, first and second water-stop pieces extending from ends of the respective first and second opposite side walls remote from the bottom and being bent inward from the opposite side walls along outer bend lines that extend substantially parallel to the longitudinal direction, each of the water-stop pieces further being bent at a location spaced from the respective side wall about an inner bend line that extends substantially parallel to the longitudinal direction so that a free end of the respective water-stop piece is opposed to and facing the bottom of the coupling portion, a mount portion being defined on an outer peripheral surface of each of the water stop pieces and the side walls, the mount portion extending from the bottom of the coupling portion to the inner bend lines, the opening edge of the heat shrinkable tube terminating on the mount portion and the inner peripheral surface of the heat shrinkable tube adjacent the opening edge of the heat shrinkable tube closely contacting the mount portion, and a draining portion provided on a side closer to the terminal connecting portion than the opening edge of the heat shrinkable tube for preventing water from running from a terminal connecting portion side to the opening edge of the heat shrinkable tube.

8. The terminal of claim 7, wherein the draining portion is a step portion rising in a step-like manner.

9. The terminal of claim 7, wherein the draining portion is a cut surface formed by cutting a metal plate material and provided on a side edge part of the coupling portion.

10. The terminal of claim 7, wherein:

the coupling portion is formed of a bent metal plate material; and the draining portion is formed by a cut portion provided on a side edge part of the coupling portion.

11. The terminal of claim 7, wherein the coupling portion is formed of a bent metal plate material; and the draining portion is a projecting piece formed by extending a side edge part of the coupling portion.

12. The terminal of claim 7, wherein the coupling portion includes an inclined portion inclined to guide adhering water toward the draining portion.

13. The terminal of claim 7, wherein the inner bend lines abut one another.

14. The terminal of claim 13, wherein the inner bend lines and the outer bend lines of the first and second water stop pieces lie substantially in a common plane.

15. The terminal-attached wire of claim 1, wherein the inner bend lines abut one another.

16. The terminal-attached wire of claim 15, wherein the inner bend lines and the outer bend lines of the first and second water stop pieces lie substantially in a common plane.

* * * * *